US008043412B2

(12) United States Patent
Carlson

(10) Patent No.: US 8,043,412 B2
(45) Date of Patent: Oct. 25, 2011

(54) HIGH VOLUME, MULTIPLE USE, PORTABLE PRECIPITATOR

(75) Inventor: Duane C. Carlson, N. Augusta, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 409 days.

(21) Appl. No.: 11/920,882

(22) PCT Filed: Apr. 21, 2006

(86) PCT No.: PCT/US2006/014979

§ 371 (c)(1), (2), (4) Date: Mar. 12, 2009

(87) PCT Pub. No.: WO2006/137966

PCT Pub. Date: Dec. 28, 2006

(65) Prior Publication Data

US 2009/0301299 A1 Dec. 10, 2009

(51) Int. Cl.
*B03C 3/53* (2006.01)

(52) U.S. Cl. ..... 95/64; 95/78; 95/79; 96/52; 96/63; 96/77; 96/96

(58) Field of Classification Search ..... 95/64, 71, 95/75, 78, 79; 96/44, 45, 52, 63, 75–77, 96/96, 413

See application file for complete search history.

(56) References Cited

U.S. PATENT DOCUMENTS

| | | | | | |
|---|---|---|---|---|---|
| 2,181,767 | A * | 11/1939 | Penney | | 96/79 |
| 2,875,845 | A * | 3/1959 | Penney | | 96/85 |
| 3,444,667 | A | 5/1969 | Mullin | | |
| 4,213,766 | A * | 7/1980 | Wyatt | | 95/78 |
| 5,077,500 | A * | 12/1991 | Torok et al. | | 315/111.91 |
| 5,137,546 | A * | 8/1992 | Steinbacher et al. | | 95/71 |
| 5,348,571 | A * | 9/1994 | Weber | | 96/68 |
| 5,667,563 | A * | 9/1997 | Silva, Jr. | | 96/50 |
| 5,993,521 | A * | 11/1999 | Loreth et al. | | 96/69 |
| 6,087,183 | A * | 7/2000 | Zaromb | | 436/178 |
| 6,090,189 | A * | 7/2000 | Wikstrom et al. | | 96/69 |
| 6,251,171 | B1 * | 6/2001 | Marra et al. | | 96/69 |
| 6,878,192 | B2 * | 4/2005 | Pasic | | 96/66 |
| 6,955,075 | B2 | 10/2005 | Carlson et al. | | |
| 2004/0083790 | A1 * | 5/2004 | Carlson et al. | | 73/28.02 |

FOREIGN PATENT DOCUMENTS

| | | | | |
|---|---|---|---|---|
| JP | 4-135661 A * | 5/1992 | | 96/96 |

OTHER PUBLICATIONS

Int'l Search Report and Written Opinion, Sep. 20, 2006, Washington Savannah River.

* cited by examiner

*Primary Examiner* — Richard L Chiesa
(74) *Attorney, Agent, or Firm* — J. Bennett Mullinax, LLC

(57) ABSTRACT

A portable high air volume electrostatic collection precipitator for analyzing air is provided which is a relatively small, self-contained device. The device has a collection electrode adapted to carry a variety of collecting media. An air intake is provided such that air to be analyzed flows through an ionization section with a transversely positioned ionization wire to ionize analytes in the air, and then flows over the collection electrode where ionized analytes are collected. Air flow is maintained at but below turbulent flow, Ionizable constituents in the air are ionized, attracted to the collection electrode, and precipitated in the selected medium which can be removed for analysis.

9 Claims, 3 Drawing Sheets

HIGH VOLUME, MULTIPLE USE, PORTABLE PRECIPITATOR

STATEMENT OF GOVERNMENT RIGHTS

The United States Government has rights in this invention pursuant to Contract No. DE-AC09-96SR18500 between the U.S. Department of Energy and Westinghouse Savannah River Company, LLC.

CROSS REFERENCE TO RELATED APPLICATION

This application is a national stage of International Application No. PCT/US06/14979 filed on Apr. 21, 2006.

FIELD OF THE INVENTION

This invention relates to high air volume electrostatic precipitators capable of using a variety of interchangeable collector media associated with the precipitator electrodes. More specifically, the invention is directed to a portable electrostatic precipitator capable of collecting analytes from air and concentrating them on or in appropriately selected collection media. In addition, the invention relates to a method for obtaining and concentrating analytes from high volumes of air, particularly at selected locations so that even minute traces of effluent chemicals used for making bombs or illegal drugs can be detected as well as bacteria, spores, molds, and fungi.

BACKGROUND OF THE INVENTION

Electrostatic precipitators, or collectors, are known to the art. In the simplest form, an electrostatic precipitator has a collection electrode that is charged to a relatively high electrostatic potential. Adjacent to, but spaced apart from, the collection electrode is another surface that is electrostatically charged. The collection electrode and the adjacent surface are oppositely charged by a power source, thereby creating an electrostatic field. As air and any constituents of the air move into the electrostatic field, the ionizable constituents of the air are ionized or charged. The ionizable constituents then are attracted to and collect on the collection electrode or in an associated collection medium.

There are two main types of electrostatic precipitators. Dry precipitators perform essentially as described above. Constituents collected on the electrode must be periodically wiped off or otherwise removed from the electrode, or the electrode must be replaced. Wiping mechanisms may be used, or the precipitator must be periodically shut down for cleaning.

Wet or liquid electrostatic precipitators also make use of collection electrodes. In this type of precipitator, however, the collection electrode is periodically or continually washed with a liquid. In these types of precipitators, the collection electrodes are generally tubular or are planar sheets or plates that are arranged either horizontally or vertically. In a vertical arrangement a liquid such as water is conveyed along the upper edges of the sheets or plates such that it flows down the electrodes. The liquid serves to clean the collection electrode (s) on a continuous or periodic basis, avoiding the need to stop the operation of the precipitator to clean or replace electrodes. The liquid is typically conveyed to a disposal system where it can be filtered and otherwise cleaned. Examples of wet precipitators are described in U.S. Pat. No. 3,444,667 to D. D. Mullen and in U.S. Publication No. 2004/0083790A1 of Duane C. Carlson, et al.

There are numerous designs of the two types of precipitators briefly described above and known to the art. The large precipitators are typically used in industrial and commercial applications to clean ventilation air in buildings of dust and other constituents, or to clean exhaust air from chemical and other manufacturing processes. To accomplish this, the precipitators are designed to provide the greatest surface area possible for collection electrodes to increase the efficiency of the cleaning process. These structures require correspondingly large enclosures. Also, precipitators of this size for these purposes require significant amounts of electrical power to create and maintain the electrostatic fields. An industrial device of this type is described in U.S. Pat. No. 5,125,230 to Robert Leonard.

For the foregoing reasons, electrostatic precipitators known to the art are generally limited to use in fixed locations. They are also limited to use at locations having space available for such apparatus, and at locations having sufficient resources, such as available power. These requirements also limit use of such precipitators to locations and to uses justifying the expenditures necessary to install, operate, and maintain such devices. While most precipitators known in the art are limited to specific uses such as cleaning air that is being taken in to a facility or to air that is being exhausted from a facility, there are also sampling precipitators that are used for removing ionized particles for identification.

SUMMARY OF THE INVENTION

The invention disclosed and claimed herein, while operating on some of the same principles as precipitators known in the art, presents an electrostatic precipitator that overcomes limitations inherent in precipitators described above and provides a method of sampling air at selected locations for different charged particles.

Accordingly, it is one object of the present invention to provide an electrostatic precipitator that is portable and can accommodate a variety of collection media at relatively high rates of air flow so that trace chemicals or bacteria may be detected.

It is another object of the invention to provide an electrostatic precipitator that is capable of collecting constituents or analytes from air at a selected location in a manner so that the analytes can be subsequently analyzed.

It is likewise an object of this invention to provide a precipitator that can easily be transported to a selected location, operated at that location, and samples from said precipitator can be immediately analyzed or transported to a facility for analysis of analytes collected from the air at the selected location.

It is a further object of this invention to provide a portable electrostatic precipitator capable of concentrating analytes from air in media selected to react to anticipated analytes such that even minute amounts of analyte present at a collection location can be detected and analyzed and differing collection media may be interchangeably used.

To accomplish the foregoing and other objects, the present invention provides a portable, high air volume electrostatic precipitator comprising air stream passage having an inlet end and an outlet end and being further defined by upper and lower walls; at least one fan operative to draw air into said passage at the inlet end and out through said outlet end at a velocity that is up to the velocity that will produce turbulence in the air stream passing through the passage, said fan having a portable power source associated therewith; an ionization wire located in said air passage near the inlet end, said wire being positioned so that its length is transverse to the direction of the flow of air in said passage; an ionization plate operatively connected to and spaced apart downstream from said wire, said plate being adjacent said upper wall; a collection electrode located below said upper plate adjacent said lower wall; a collection medium positioned adjacent and above said collection electrode and a portable ionization power source operatively connected to said wire, plate, and collection electrode to create an electrostatic field capable of ionizing analytes in said air whereby ionizable analytes in said air are electrostatically precipitated into or on said collection medium. Said precipitator may be liquid in an open tray or receptacle or reservoir. The medium may also be a paste or gel, a metallic plate, or a nutrient. In another aspect, the precipitator of the present invention comprises a first or ionization region at its inlet end which comprises an ionization wire disposed therein transverse to the air flow direction, said ionization wire being positioned approximately midway between upper and lower ground plates; a second or collection region having an upper plate with a negative potential and a lower plate at a positive potential which acts as the collection plate or receptacle for a collection medium, a transition region between said first ionization region and said second collection region to direct air that flows through said first region through and into the second region; an exhaust region to receive air that is passed through the second region; and at least one fan or air impeller or pump which moves the air through said aforementioned region, said fan being capable of moving air through said second ionization region at a laminar flow rate that is up to the turbulence flow rate of air through said region.

In another aspect, the invention is a method for collecting analytes from air comprising the steps of: passing a stream of air through a passage having an ionization wire positioned therein with its length transverse to the direction of air flow; subsequently passing said air stream between an upper charged plate and a lower collection electrode and over a collection medium positioned adjacent said collection electrode; maintaining an electrostatic voltage potential between the collection electrodes maintaining the air flow over said collection medium at a velocity that approaches but is less than the velocity that creates turbulent flow whereby ionized analytes from the air stream may be collected in or on the medium from a relatively high volume of air in a short period of time. The method also includes providing a liquid collection medium, a paste or gel collection medium, a nutrient collection medium, or a plate of a metal or plastic material as the collection medium. The method also includes removing an exposed sample of medium and analyzing same. In this manner the presence of illegal activities such as that of labs producing methamphetamine can be detected.

The foregoing invention will be better understood from the drawings and detailed description which follow.

BRIEF DESCRIPTION OF THE DRAWINGS

Attached hereto and made a part of this disclosure are the following described drawings which are presented by way of illustration and not limitation. In the drawings.

DETAILED DESCRIPTION OF THE INVENTION

Figure 1:
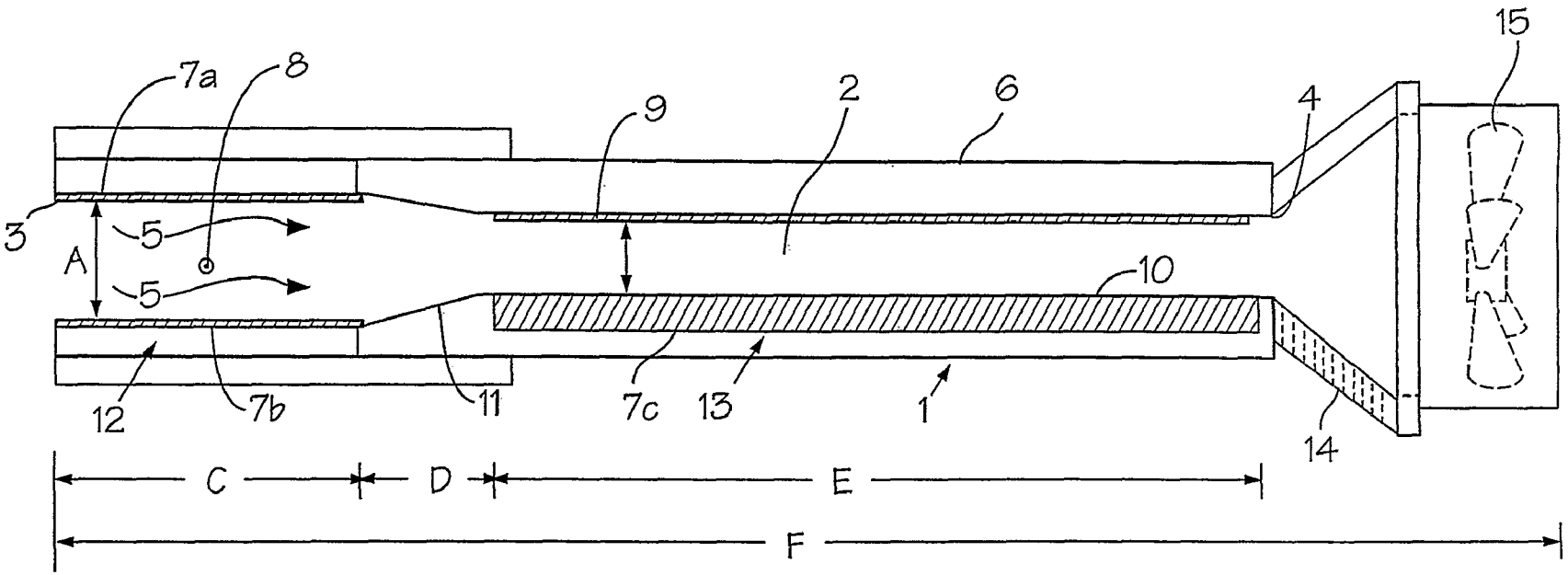
FIG. 1 is a schematic side view of a preferred embodiment of the precipitator of the present invention.

While a very significant use of electrostatic precipitators has been for treating air streams for cleaning purposes, the present invention is directed towards analyzing the content of an air sample being processed. Any portion of the air, such as gases, microbes (including any airborne microorganisms such as spores, bacteria, fungi, and the like), dust or any other particles that may be entrained in or carried by the air (hereafter referred to as "analytes") that can be ionized by an electrostatic field, can be collected on a collecting electrode and thereafter analyzed. In dry precipitators, the analytes can be periodically removed from the electrode and conveyed to an analyzer. In wet precipitators, the liquid used to wet the electrodes can similarly be conveyed to an analyzer for analysis. In existing precipitators, however, the air stream to be analyzed is often limited to the air stream being treated at a fixed facility.

The present invention takes advantage of the efficiencies of electrostatic precipitation in a portable, self-contained unit that enables the collection, concentration, and analysis of air-borne analytes at virtually any selected location. The unit can be transported easily to a selected location where collection or analysis of air-borne analytes is desired. The unit can be operated by an operator at the desired location, or can be provided with a communications device, such as a simple radio transceiver, allowing operation from a remote location.

In a preferred mode, the unit includes a portable power source which can, for example, be a standard automobile battery. The unit can also be adapted to use an on-site power source, or can use any of a variety of specialized batteries, including the batteries for portable computers, laptops, games or solar panels. The requirements for the power source for the precipitator are that it must (1) be capable of producing an electrostatic field of the desired intensity and (2) have sufficient additional power to operate other components of the unit, such as transmitters or air pumps, all of which will have relatively low power requirements. The portable power source provides all the power needed for the functions of the precipitator, and the exact requirements of power can easily be determined by those of skill in the art.

While electrostatic precipitation of particles from the atmosphere into a liquid medium has been performed in the prior art, the type of apparatus was quite different from the present invention. Prior art apparatus required general electric power of 120-volts whereas mentioned in the previous paragraph the present invention can be operated by battery. The prior art devices were often the size of a desktop and weighed more than 100 pounds requiring two or more people to move the device. The present invention weighs less than 5 pounds exclusive of batteries and can be put into a brief case.

In addition to its size, weight, and mobility, the present invention is also a high volume processor or air processing 1,000 liters per minute or more.

The present invention also has a high efficiency for collection of very fine particles and preferably collects them in a liquid that can be chosen for the specific purpose. This ensures that an antibody for an expected micro-organism that is collected may be added to rapidly identify its presence. The collection efficiency can be greater than 80% for 1.0 micron particles and more than 70% for 0.3 micron particles.

The present invention processes air at the high volume or high velocity rate though a first ionization section in which airborne particles are negatively ionized in an electric field of preferably about 10,000 volts. The ionized particles, which can include bacteria and spores, are then collected in a liquid medium in a field of preferably about 15,000 volts. The liquid is preferably contained in a 100 milliliter reservoir positioned on and covering the base or collection plate. Bacteria are collected in this reservoir and remain viable. The precipitator of the present invention has been tested with water, nutrient solutions, and low vapor pressure organic compounds such as ethylene glycol and fluorocarbon compound FC-70 for work in low humidity environments. If a specific element or compound is being sampled, the medium can be a solution of an indicator specific for that element or compound. Analysis can be made by removing and circulating the collector liquid through infrared or ultraviolet cells in a corresponding spectrometer. Another embodiment uses a scintillation cocktail as a collector liquid and then circulating the liquid through a scintillation counter after collection when sampling for radio nuclei. For bacteria, the liquid can contain antigens specific to a particular species being sought.

Operating experiences demonstrate that a camcorder type of battery can be used to operate the present invention for up to 8 hours and can operate as long as 100 hours with an automobile battery. The operation is very quiet and does not create a noise level greater than an ordinary desktop computer.

Turning now to the drawings, in FIG. 1 a schematic cross-section representation of the preferred embodiment of the invention is shown. This is also the present best known mode of the invention. In this figure, precipitator 1 is shown as having air passageway 2 extending through its length from inlet 3 to outlet 4. The direction of flow of the air is indicated by arrows 5. Upper and lower walls 6 enclose the passageway which includes ground plates 7*a, b* that are spaced apart at the inlet end and disposed of preferably midway between the ground plates is ionization wire 8. Ionization wire 8 is positioned so that its length is transverse or perpendicular to the air flow in the passageway. The ground plates 7*a* and 7*b* and ionization wire 8 define a first ionization region 12. This is the initial point at which air entering the inlet 3 will encounter the electrostatic field created in the ionization region 12 which preferably will be at a voltage of about 10,000 negative.

Transition region 11 connects the first ionization region 12 to the second collection region 13. In the preferred embodiment the distance A between the two ground plates 7*a*, 7*b* is about 1" and the distance B between the upper plate 9 and the medium collection surface of reservoir 10 is also about 1". The length C of the first ionization region 12 is about 2½" and the length D of the transition region 11 is about ¾. The second or collection region 13 is about 8" long (E) and comprises the upper charged plate 9, and the medium collection drawer 10. The potential difference in this region between the charged plate 9 and the ground plate 7*c* is preferably about 15,000 volts negative. The total length F is about 15".

Figure 3:
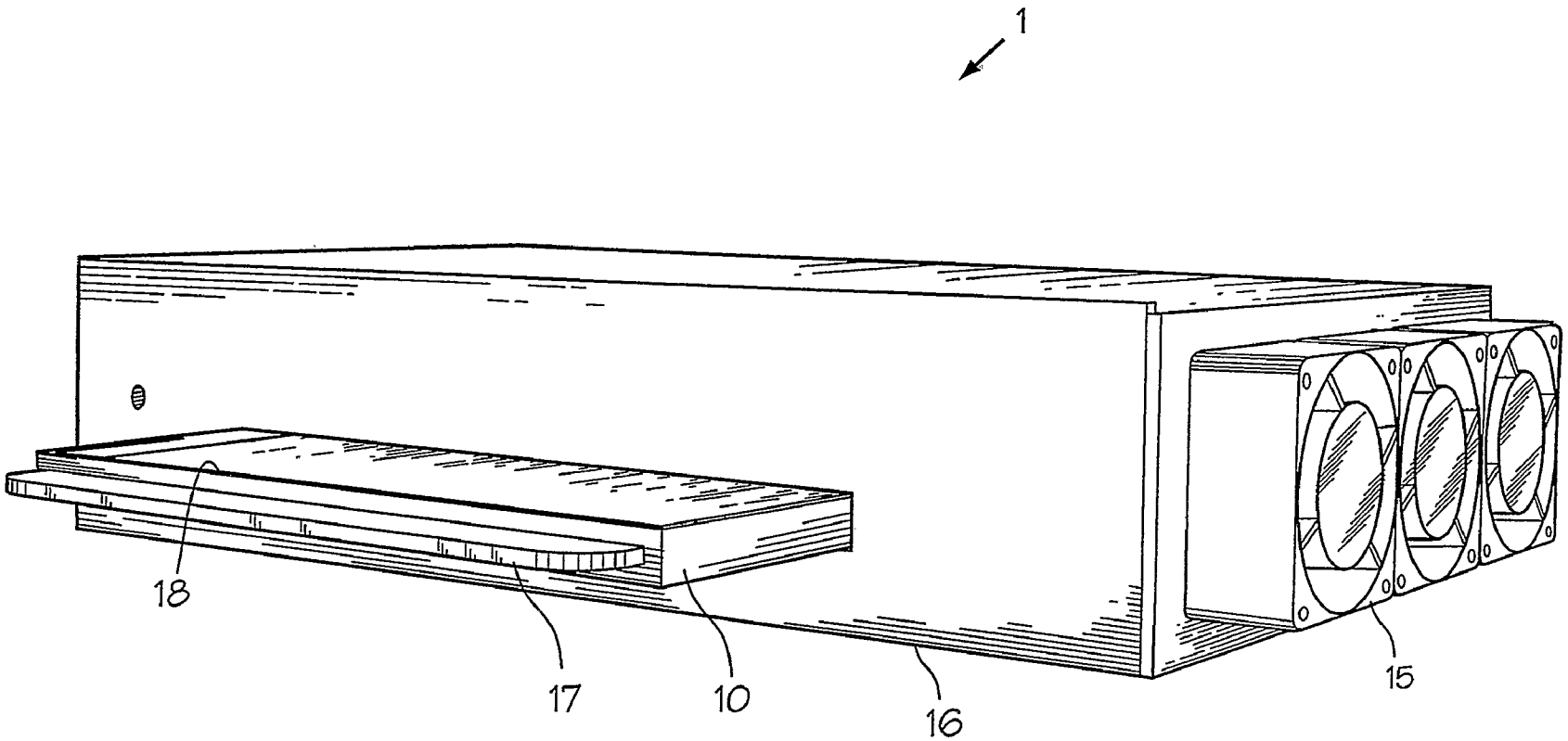
FIG. 3 is a perspective representation of the precipitator in FIG. 2 showing the exhaust or outlet end of the precipitator and the sample tray in greater detail.

At the outlet end 4 of the precipitator is located the exhaust region 14 through which air is drawn by fan 15. An array of three fans 15 is preferred along the rear width of precipitator 1. In the preferred embodiment three fans rated at 600 l/m are used. This can be seen better in FIG. 3 which shows the precipitator 1 from the exhaust end where fans 15 are located. This view shows precipitator housing 16 that encloses the precipitator internals as described in FIG. 1. Drawer handles 17 is shown with collector tray 10 being pulled to the outside so that the tray 18 which is carried by the medium drawer may be removed. The reservoir or receptacle is preferably about 8" wide and 8" long and about 3/16" high. With these dimensions it will accommodate 100 milliliters of liquid. Pastes or gel can also be used and can be selected with a chemical composition that reacts with anticipated analytes particularly those found in the air in the vicinity of the production of illegal substances.

Figure 2:
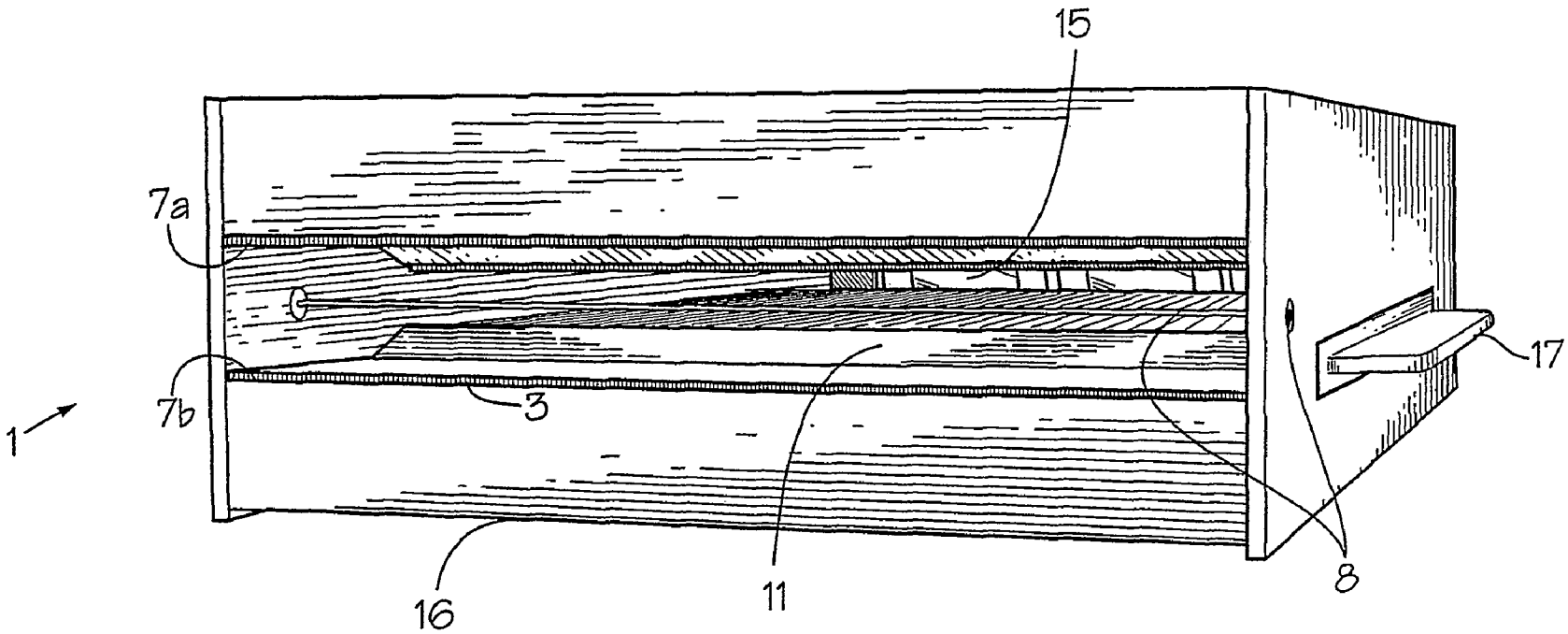
FIG. 2 is a perspective representation of the precipitator of FIG. 1 enclosed in a housing and shows the inlet end and sample removal drawer.

FIG. 2 illustrates the inlet 3 end of the precipitator 1 showing the edges of the ground plates 7*a* and 7*b* which are enclosed in housing 16. The width of housing 16 will be in the order of 8½ to 9".

In the foregoing embodiment, the location and connection of the power supply, switches, wiring, and mounting of parts are well within the skill of those in the art and these components are readily available and selectable.

In operation, precipitator 1 is placed at a location where it has been decided that a sample be taken. Air is drawn through the first ionization region 12 where the electrostatic field created by ionization wire 8 ionize analytes as these analytes pass through the transition region into the second ionization or collection region 13 where they are precipitated onto the collection medium which is carried by the medium drawer 10. An effect discovered in the development of the electrostatic precipitation collectors is that turbulence can occur in the air flow stream as it passes through a passageway such as passageway 2 drawn by fan 15 at high velocity and turbulence has a significant effect on the efficiency of the collection of analytes. Thus, it is desirable to keep the air flow in the laminar flow region so that turbulence does not occur or is avoided. Turbulence over a liquid collection surface causes surface instability with wave or ripple effects, thus lowering collection efficiency. Operation of the foregoing described preferred embodiment has shown that a maximum efficient capacity of about 1,200 liters per minute can be obtained and that about 1,000 liters per minute is recommended as, at this volume rate of air, the water surface in the collection tray remains very stable. When the volume rate is raised to about 1,200 liters per minute, the liquid does begin to shimmy and the tray can overflow. If higher rates are used, the turbulent air simply blows the liquid away.

In evaluating the efficiency of collection, the collection efficiency is determined by the particles coming in compared with the particles going out. Collection efficiencies run in the range from 75 to or greater than 85%. With a wet collection medium the collection efficiency is improved with the use of the transverse ionization wire and plate combination. For all particle sizes, it appears that efficiency of collection drops at rates greater than 1,200 liters per minute. The efficiencies will also vary with the size of the passageway. Optimum size precipitator dimensions can be determined by those skilled in the art for ambient conditions so that precipitators according to the present invention can be operated most efficiently.

The invention has been described above with reference to a preferred embodiment. However, upon reading this disclosure other embodiments of the invention may become apparent to those skilled in the art. The present invention is limited only to the scope of the claims that follow:

I claim:

1. A portable, high air volume electrostatic precipitator comprising:

a) an air stream passage having an inlet end and outlet ends and upper and lower walls;

b) a fan operative to draw air into said passage at the inlet end and out through said outlet end at up to the velocity that will produce turbulence in the air stream passing therethrough, said fan having a portable power source associated therewith;

c) an ionization wire located in said air passage near the inlet end, said ionization wire being positioned so that its length is transverse to the direction of the flow of air in said passage;

d) a charged plate operatively connected to and spaced apart downstream from said wire, said plate being adjacent said upper wall;

e) a collection electrode located below said upper plate adjacent said lower wall;

f) a collection medium positioned adjacent and above said collection electrode and, g) a portable ionization power source operatively connected to said wire, plate, and electrode to create one or more electrostatic fields having the same or different potential levels that are capable of ionizing analytes in said air whereby ionizable analytes in said air are electrostatically precipitated on or into said collection medium.

2. The precipitator of claim 1 wherein the collection medium is a liquid in an open receptacle positioned on said collection electrode.

3. The precipitator of claim 1 wherein the collection medium is a paste or gel positioned in a container on said collection electrode in an open receptacle.

4. The precipitator of claim 1 wherein the collection medium is selected to react with analytes from bomb or drug making activities in a readily detectable manner.

5. The precipitator of claim 1 wherein the collection medium is a nutrient.

6. The precipitator of claim 1 wherein the collection medium is selected from the group consisting of liquids, pastes, metal and plastic plates, and nutrients.

7. A method for collecting analytes from air comprising the steps of:

a) passing a stream of air through a first ionization region defined by a passageway having at least one ground plate and a spaced apart ionization wire positioned therein with its length transverse to the direction of air flow;

b) subsequently passing said stream of air between an upper charged plate and a lower collection electrode that define a second ionization region and over a collection medium positioned adjacent said collection electrode;

c) maintaining an electrostatic voltage potential between the ionization wire and the ground plate and between the charged plate and the collection electrode in said first and second regions;

d) maintaining the air flow over said collection medium at a velocity that approaches but is less than the velocity that creates turbulent flow whereby ionized analytes from air may be collected in or on the medium.

8. The method of claim 7 wherein the electrostatic potential in the second region is maintained at a level higher than that of the first region.

9. The method of claim 7 wherein the collection medium is selected from the group consisting of liquids, pastes, metal and plastic plates, and nutrients.

* * * * *